United States Patent [19]

Kobori

[11] 4,345,185

[45] Aug. 17, 1982

[54] CATHODE RAY TUBE APPARATUS

[75] Inventor: Yuzuru Kobori, Tokyo, Japan

[73] Assignee: Sony Corporation, Tokyo, Japan

[21] Appl. No.: 158,117

[22] Filed: Jun. 10, 1980

[51] Int. Cl.[3] ..... H01J 29/96

[52] U.S. Cl. ..... 315/3; 315/16

[58] Field of Search ..... 315/3, 16, 59, 61, 71; 313/449

[56] References Cited

U.S. PATENT DOCUMENTS 4,243,911 1/1981 Winarsky et al. ..... 315/3

4,255,689 3/1981 Fischman et al. ..... 315/3

*Primary Examiner*—Eugene R. LaRoche

*Attorney, Agent, or Firm*—Hill, Van Santen, Steadman, Chiara & Simpson

[57] ABSTRACT

A cathode ray tube apparatus in which a discharge current suppressing means is inserted into the discharge current flowing path between the final electrode of the electron gun of a cathode ray tube and the stem pin thereof within the cathode ray tube.

5 Claims, 8 Drawing Figures

CATHODE RAY TUBE APPARATUS

BACKGROUND OF THE INVENTION

1. Field of the Invention

The present invention relates generally to a cathode ray tube apparatus, and is directed more particularly to a cathode ray tube apparatus in which when a discharge is caused in a cathode ray tube, the discharging current is suppressed so as to induce a voltage by the discharge only in the tube thereby to reduce undesirable influences which are exerted on the cathode and heater of the cathode ray tube and the electrodes of an electron gun and so on as much as possible and hence to reduce undesirable influences on the circuit elements forming the cathode ray tube apparatus.

2. Description of the Prior Art

In the prior art cathode ray tube apparatus, discharge is frequently generated in the tube or envelope. For example, in a color cathode ray tube apparatus of the Trinitron (registered Trade Mark) system, as shown in FIG. 1, for a plurality of cathodes Kr, Kg and Kb in an envelope 1, arranged are common first to fifth grids G1 to G5 on the same axis, and a convergence device CD, which is formed of four electrodes and disposed at the front end of fifth grid G5 to form an electron gun 2. In this case, an anode voltage is applied to the fifth and third grids G5 and G3, which are electrically connected through a high voltage lead wire 6, from the outside of the envelope 1 through, for example, an anode button (not shown), inner carbon layer 3 and conductive contact spring 4, while a predetermined low voltage is applied to the first, second and fourth grids G1, G2 and G4 through a stem pin 5. Though not shown, the inner deflection plate of convergence device CD is applied with the anode voltage through the contact spring 4 and the outer deflection plate of convergence device CD is applied with a middle high voltage, which is somewhat lower than the anode voltage, from the coaxial anode button through, a high voltage supply pipe (not shown).

With the above prior art color cathode ray tube apparatus, there may occur a case where a discharge is generated between the high voltage electrodes or fifth and third grids G5, G3 and the lower voltage electrodes or fourth and second grids G4, G2, in detail between the fifth grid G5 and fourth grid G4 or between third grid G3 and fourth grid G4, or between the third grid G3 and second grid G2, respectively. The above discharge is the discharge of the electrical charges stored in a capacitor formed between the inner carbon layer 3 and the outer carbon layer 7. In this case, a current i flows into the outer carbon 7 through the path indicated by the arrow in FIG. 1.

FIG. 2 is an equivalent circuit of the above discharging current path. In FIG. 2, 8 designates the discharge gap, R a total resistance, C the above defined capacitance and L a total inductance, respectively.

When the discharge occurs, it can be ascertained by measurements of a current peak of several hundred amperes which is reached in 100 to 200 nanoseconds and the time rate of current change reaches about 10,000 A/μs. It is obvious that such large currents seriously affect the cathode ray tube and the circuit elements disposed near the cathode ray tube.

In order to reduce damage caused by the above discussed discharge, it is sufficient to introduce a high impedance within the discharge path. To this end, in the art such a system has been known, in which resistive particles are mixed into the inner carbon layer 3 to give a predetermined resistance value thereto to reduce the discharge current. This is known as a so-called resistive carbon coating method. In another method a resistive layer is coated on the contact spring 4, contacting with the inner carbon layer 3 and applying the high voltage to the electron gun 2, to reduce the discharge current, which is known as the resistive contact-spring system.

In any of the prior art systems, as will be clear from the above description, the resistive material serving to reduce the discharge current is provided within the cathode ray tube for the following reasons. That is, in order to remove the undesirable influences by the discharge on the respective parts of the cathode ray tube and the circuit elements thereabout, the following three points are important.

(1) The discharge current is suppressed.

(2) The rising-up of the discharge current is to be low i.e. the differentiated value of the discharge current with respect to time di/dt is made small, and (3) The induction of high voltage by the discharge is generated within the cathode ray tube.

It is not necessary to explain the above point (1). As to point (2), since a ground lead wire 9, which is connected between the side of stem pin 5 and the outer carbon layer 7, has a small coil or inductance component to induce a high voltage at the side of stem pin 5 in accordance with the equation $E=L\times di/dt$ upon discharging and the magnetic material near it is magnetized by the rising-up factor di/dt or voltage is induced in the deflection yoke to damage the circuit elements, the rising-up factor di/dt must be made small. In order to satisfy the points (1) and (2), it may be desirable to introduce an impedance to the outside of the cathode ray tube, for example, the ground lead wire 9. However, if the impedance is provided at the outside of the cathode ray tube as set forth above, upon discharging a high voltage is induced at the side of the stem pin 5 to undesirably affect the circuit near the same. For this reason, when the impedance for preventing the discharge current is provided, it is selected to be only within the cathode ray tube in the prior art.

However, in the prior art resistive carbon coating system or resistive contact-spring system, are accompanied with the following defects.

First, the resistive carbon coating system will be described. In the resistive carbon coating system, as shown in FIG. 3, the resistance value of the inner carbon layer 3 in contact with the conductive contact spring 4 is selected to be high. In this case, however, the contact between the contact spring 4 and the carbon layer 3 results in the peeling-off of carbon layer 3 to increase the possibility of discharge. Even if the discharge is caused frequently, the discharge is feeble (soft). Therefore, undesirable influences on the circuit neat it will be caused, but the picture flickers frequently during discharging which is uncomfortable for a viewer. Further, due to the fact that the contact of the spring 4 with the carbon layer 3 is a point contact, the deterioration of the carbon layer 3 proposes a problem. That is, during a discharging or nocking treatment, a current will flow through a very small portion, which may deteriorate the carbon layer 3 due to the heat generation and hence lower the reliability. In addition, when a gas absorbing agent called a getter which is highly conductive adheres to the carbon layer 3, the effect of carbon layer 3 and its resistance disappears.

Therefore, it is necessary to shield an area A of the carbon layer 3, which may make contact with the contact spring 4, so as to prevent the adhesion of at least the getter to the carbon layer 3. In fact, however, it is difficult to positively shield the area A of the carbon layer 3. In this case, a device to shield the area A is required, which results in the construction of the cathode ray tube becoming complicated.

To avoid a problem, such a method may be considered where a non-doped getter is used. This non-doped getter has a property such that the scattering of barium Ba by nitrogen gas $N_2$ is not caused but barium is deposited directly, so that the shield can be easily constructed. According to the experiments, however, it was ascertained that the non-doped getter deteriorated the uniformity of the color on the picture screen and the area deposited with barium becomes small due to the non-porosity of the deposited barium layer, which resulted in reduction of the gas absorption effect and consequently in a short life span of the cathode ray tube. Further, even if the shield can be provided, the shield effect fluctuates, which results in the scattering of the discharge current and accordingly positive shielding effect is not assured. Also, the getter is generally attached to the electron gun 2 with a metal plate. In the resistive carbon coating system, however, if the electron gun and the getter are not isolated electrically, the discharge current will flow through the metal plate. To avoid this, such a technique is necessary where the getter is attached to a color selecting mask, anode button or the like, which results in difficulties during manufacturing process.

Further, the maintenance or control of the static resistance and the dynamic resistance is difficult. The static resistance means the quotient of several volts difference set between the carbon layers by the current flowing to the carbon layers by the voltage difference, and the dynamic resistance means the quotient of the high anode voltage divided by the peak value of the discharge current. Upon comparing the static resistance with the dynamic resistance, the dynamic resistance has a tendency to decrease. This difference is determined mainly by the surface condition and the inner construction of the carbon layer 3, because the discharge along the surface of the carbon layer 3 (surface discharge) is determined by its surface condition and the impedance (the resistance to AC) is determined by the inner construction of the carbon layer 3. The maintenance or control thereof becomes important to maintain the results certain. The control of the grain size of the carbon powders or the coating method thereof may be considered, but the resistive carbon coating system lacks the ability to prevent fluctuations of the shield effect by the getter.

Secondly, the resistive contact spring system will be now described. According to this system as shown in FIG. 4, a resistive layer 10 is coated on the surface of the contact spring 4, which contacts with inner carbon layer 3, to reduce the discharge. This system, however, is not practical. That is, even if the resistive layer 10 is coated on the surface of the spring 4 or disposed between the spring 4 and carbon layer 3, the thickness of the resistive layer 10 is small so that discharge along the surface will be caused. In other words, the voltage across the resistive layer 10 becomes a high voltage due to the discharge which will cause the secondary discharge along the surface due to the short length, so that the discharge can not be suppressed. Further, it is necessary to shield the resistive layer 10 so as to prevent it from being coated by the back flash of the conductive getter material. In addition to the surface condition and the inner construction of the resistive layer 10, there exists a problem due to the capacitance since, due to the short distance between the inner carbon layer 3 and the contact spring 4, a capacitance C1 exists therebetween. The equivalent circuit thereof can be as shown in FIG. 5. Thus, the high frequency current such as the discharge current flows through the capacitance C1. As a result, the impedance (AC resistance) thereof becomes low, and accordingly the effect by the provision of the resistive layer 10 is limited even if the static resistance is selected to be relatively high.

OBJECT AND SUMMARY OF THE INVENTION

Accordingly, an object of the present invention is to provide a novel cathode ray tube apparatus free of the defects encounted in the prior art.

Another object of the invention is to provide a cathode ray tube which is simple in construction but can positively prevent the generation of discharge current without damaging the heater, cathodes and so on with in the cathode ray tube.

A further object of the invention is to provide a cathode ray tube in which a discharge current suppressing means such as a resistor or coil is inserted into the discharge current flowing path between the final electrode of an electron gun supplied with high voltage and a stem pin for supplying low voltage to suppress the discharge current and hence to avoid undesirable affects on the cathode ray tube and circuit elements thereof.

According to an aspect of the present invention, a cathode ray tube apparatus is provided, which comprises a cathode ray tube having an electron gun wherein a discharge current suppressing means is inserted into the discharge current flow path between the final electrode of said gun to which an anode voltage is supplied and a stem pin to which a low voltage is supplied.

The other objects, features and advantages of the present invention will become apparent from the following description taken in conjunction with the accompanying drawings through which the like references designate the same elements and parts.

DESCRIPTION OF THE PREFERRED EMBODIMENTS

The present invention will be hereinafter described with reference to the attached drawings by way of example.

Figure 1:
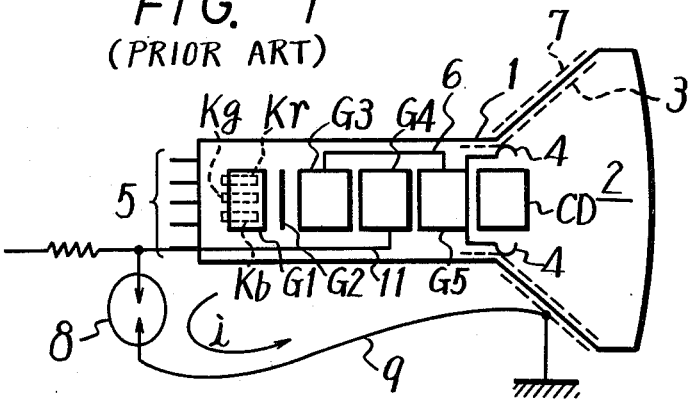
FIG. 1 (PRIOR ART)
FIG. 1 is a schematic view showing a prior art cathode ray tube.
Figure 2:
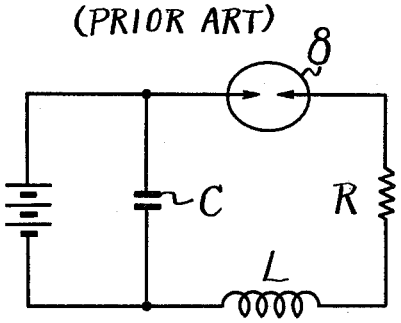
FIG. 2 (PRIOR ART)
FIG. 2 is an equivalent circuit diagram of the discharge path of the cathode ray tube shown in FIG. 1.
Figure 3:
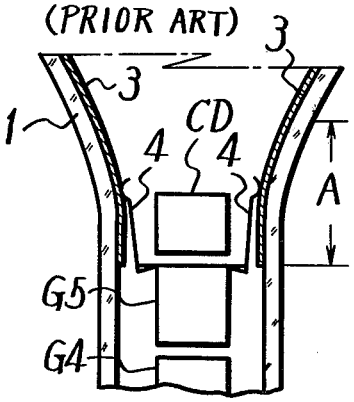
FIG. 3 (PRIOR ART)
FIGS. 3 and 4 are cross-sectional views respectively showing essential parts of discharge current suppressing devices employed in the prior art cathode ray tube.
Figure 4:
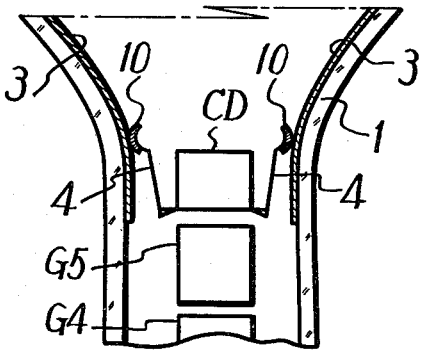
FIG. 4 (PRIOR ART)
Figure 5:
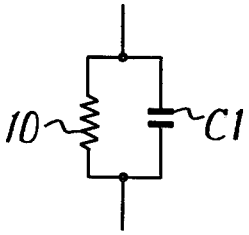
FIG. 5 (PRIOR ART)
FIG. 5 is an equivalent circuit diagram use to explain the device of FIG. 4.
Figure 6:
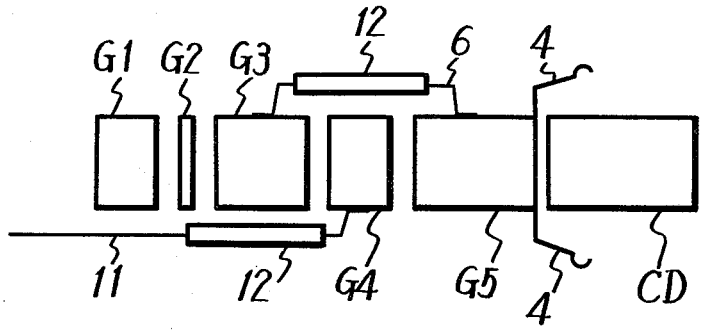
FIG. 6 is a side view showing the essential part of a cathode ray tube apparatus according to the present invention.

FIG. 6 shows an example of the invention, which is applied to a color cathode ray tube apparatus of the Trinitron (registered Trade Mark) system by way of example. In this case, FIG. 6 shows only an electron gun consisting of first to fifth grids G1 to G5 and convergence device CD of the color cathode ray tube apparatus. In this example, the discharge will take place between the high voltage electrodes such as the fifth and third grids G5, G3 and the low voltage electrodes such as the fourth and second grids G4, G2 as described as above. Upon the discharge between the grids G5 and G4, the discharge current flows through a lead member or wire 11 connected from the fourth grid G4 to the stem pin 5 (refer to FIG. 1); upon the discharge between the grids G3 and G4, the discharge current flows through the high voltage lead member or wire 6 connecting the fifth grid G5 to the third grid G3 and through the lead wire 11 of fourth grid G4; and upon the discharge between the third and second grids G3 and G2, the discharge current flows through the high voltage lead wire 6, respectively.

In the example of the invention shown in FIG. 6, resistors 12, each serving as a discharge current suppressing means are respectively inserted into the high voltage lead wire 6, which connects the third grid G3 with the fifth grid G5 of the electron gun and into the lead wire 11 connected from the fourth grid G4 of the electron gun. The resistor 12 must satisfy such a condition that it is not damaged upon discharge and is not changed especially during the knocking process carried out at the final step of manufacturing the cathode ray tube apparatus in which process, a voltage about twice as high as the operating voltage is applied so as to increase the voltage at which discharge begins and also to remove burrs and so on between adjacent grids by discharge. The resistive material used in the cathode ray tube is limited due to its effect on the cathode and so on. As the specific resistor 12, which will satisfy the above conditions, it was noted that a resistor, whose resistance variation is within 50Ω for the absolute resistance value of 3 KΩ, can be practically used without any problem. In practical use, two kinds of materials can be considered for making the resistor 12. One is a ceramic resistor which is made such that conductive metal oxide, silicon, carbon and so on are mixed with material, which is necessary for making ceramic, and the mixture is sintered at a high temperature. The other method is a resistor is manufactured such that carbon, which is used in the cathode ray tube as the inner conductive layer, iron oxide, silicon carbide SiC or the like is formed into a thin layer resistor with the form of a lead wire shape.

Figure 8:
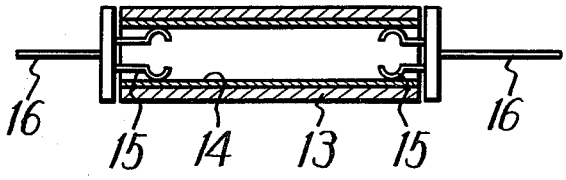

As a practical example of the latter resistor, a resistor shown in FIG. 8 may be used. This resistor consists of a hollow ceramic cylinder 13, a thin resistive layer 14 made of the above carbon or the like and coated on the inner surface of ceramic cylinder 13, contact terminals 15 are inserted into the pipe 13 for contacting the resistive layer 14 at both ends thereof, and lead wires 16 respectively led out from terminals 15.

Since the above specific resistor is made of ceramic, carbon, silicon, metal oxide and so on, which are generally used in the cathode ray tube, this resistor has less affect on the cathode. It was ascertained that such resistor was not changed even at temperatures of 400° C. to 450° C. used for the knocking process and were necessary to manufacture the cathode ray tube. It was further noted that if the length of the resistor 12 was not selected more than a certain value, there was caused a secondary discharge along the surface thereof. Since the lead wire 6, which connects the grid G3 to grid G5, and the lead wire 11 of grid G4 both have sufficient length, the above resistor 12 can be easily inserted into each of the lead wires 6 and 11 with good results.

By the way, it was ascertained that, in an ordinary cathode ray tube without the present invention, a current of 400 A (peak value) flowed and its rising-up time arrived at 10,000 A/μs, while in the cathode ray tube of the invention with the resistors 12 of 3 kΩ respectively inserted into the lead wires 6 and 11, currents passing therethrough were both less than 10 A and their rising-up was 25 A/μs, which is remarkably smaller than that of the prior art.

The above description is given for the case where the present invention is applied to the cathode ray tube which employs the uni-potential type electron gun. However, the present invention or resistor 12 can be applied to a bi-potential type electron gun with the same effect and also to an electric field lens type electron gun with substantially the same effect.

Figure 7:
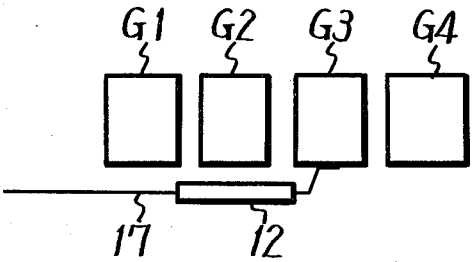
FIG. 7 is a side view showing the essential part of another example of the invention and FIG. 8 is a cross-sectional view showing an example of a resistor useable in the invention.

In case of the bi-potential type electron gun, as shown in FIG. 7, the resistor 12 can be inserted into a lead member or wire 17 led out from the third grid G3.

The present invention can be applied not only to the cathode ray tube of a television receiver but also to the cathode ray tube of an oscilloscope with the same effect.

As the discharge current suppressing means, in place of the above specific resistor, a coil may be used with the same effect.

According to the present invention described above, into the discharge current flowing path between the final electrode of the electron gun of the cathode ray tube to which electrode the high voltage is applied and the stem pin which applies the low voltage to the cathode ray tube i.e. the lead wire between the electrodes or between the electrode and the stem pin there is inserted as the discharge current suppressing means a resistor 12. Thus, the current during the discharge is suppressed, and hence the undesirable influence on the external circuit elements such as the transistors of a horizontal output circuit and video output circuit and on the heater and cathode of the cathode ray tube can be positively avoided. In this case, since the length of resistor 12 can be selected to be long due to its insertion position, no surface discharge is caused.

Further, since the resistor 12 is not affected by the getter back flash, there is no fear that barium Ba will adhere to the resistor 12 and hence the resistance value thereof will not fluctuate.

Also, when the ceramic resistor is employed as the resistor 12, it is a so-called bulk resistor. Thus, its frequency characteristic is good (the resistance value thereof does not vary with frequency), the static resistance thereof is 2 KΩ which is sufficient, and the difference between the static and dynamic resistances is very small. Therefore, the discharge current is determined by only the static resistance, so that the control thereof is positive and superior.

The ceramic resistor is not changed in its resistance value during the manufacturing process of the cathode ray tube, especially during the heat and knocking processes and the material of the ceramic resistor is the same as that used in the cathode ray tube, so that it does not affect the cathode.

Further, according to the invention, the discharge current suppressing means is merely inserted into the lead wire, so that no change is required in the manufacturing process of the cathode ray tube, and accordingly the cathode ray tube can be easily manufactured.

It will be apparent that many modifications and variations could be effected by one skilled in the art without departing from the spirits or scope of the novel concepts of the present invention, so that the spirits or scope of the invention should be determined by the appended claims only.

What is claimed is:

1. A cathode ray tube having an electron gun with at least two high voltage electrodes (G3 and G5), a low voltage supply lead, a low voltage electrode (G4) mounted between said high voltage electrodes, a first discharge current suppressing resistor connected between said two high voltage electrodes (G3 and G5) and a second discharge current suppressing resistor connected between said low voltage electrode and said low voltage supply lead.

2. The cathode ray tube as claimed in claim 1, wherein said gun is a uni-potential type gun having electrodes G1–G5.

3. A cathode ray tube according to claim 1 wherein said first and second discharge current resistors are ceramic resistors.

4. A cathode ray tube having an electron gun of the bi-potential type having first, second, third and fourth aligned electrodes, a third electrode supply lead, and a discharge current suppressing resistor connected between said third electrode supply lead and said third electrode.

5. The cathode ray tube as claimed in claim 4, wherein said current suppressing resistor is a ceramic resistor.

* * * * *